United States Patent [19]

Peng

[11] Patent Number: 5,027,454

[45] Date of Patent: Jul. 2, 1991

[54] COMBINED BED STRUCTURE

[76] Inventor: Jung-ching Peng, 293 Pei Tun Road, Taichung, Taiwan

[21] Appl. No.: 472,942

[22] Filed: Jan. 31, 1990

[51] Int. Cl.[5] ..... A47C 23/047; A47C 27/10

[52] U.S. Cl. ..... 5/402; 5/407; 5/470; 5/449

[58] Field of Search ..... 5/400–402, 5/406, 407, 449, 450, 455, 457, 464, 470, 474

[56] References Cited

U.S. PATENT DOCUMENTS

| | | | |
|---|---|---|---|
| 2,069,422 | 2/1937 | Sampson | 5/449 |
| 2,151,628 | 3/1939 | Van Derveer | 5/402 |
| 2,748,399 | 6/1956 | Rockoff | 5/449 X |
| 4,306,322 | 12/1981 | Young et al. | 5/449 |
| 4,394,784 | 7/1983 | Swenson et al. | 5/464 X |

*Primary Examiner*—Michael F. Trettel

[57] ABSTRACT

A combined bed structure comprises a frame support and a mattress frame. The mattress frame is placed on the top portion of the frame support and comprises a frame casing, an inflatable mattress, and a cover layer. The frame casing is placed on the top portion of the frame support. The inflatable mattress is placed in the frame casing. The cover layer is placed on the top portion of the inflatable mattress. An inner frame slot with a slot opening and a slot chamber is positioned in the inner surface of the top portion of the frame casing. A hollow inflatable elastic tube is able to fully expand in the slot chamber and is connected along the periphery of the cover layer, so the cover layer is fixedly secured by inflating air into the hollow inflatable elastic tube and the cover layer is removable by deflating the elastomer.

4 Claims, 2 Drawing Sheets

A — A

COMBINED BED STRUCTURE

FIELD OF THE INVENTION

The present invention relates to a combined bed structure and more particularly to a bed structure with an easily removable cover layer which periphery can be inserted to an inner frame slot of the bed structure which can lock the cover layer in position by means of the frame casing.

BACKGROUND OF THE PRESENT INVENTION

The conventional bed which has a flat upper surface in general is usually made of a wooden or steel structure. Since these conventional beds are generally too hard and uncomfortable to the sleepers, the redesigned bed which uses spring structures provides a more comfortable and softer sleeping area than the conventional beds.

The first type of spring bed structure generally comprises a plurality of vertically compressible springs which are clamped between an upper mattress pad and a lower mattress pad. The spring bed structure is covered by a cloth casing all over its outer surface. The second type of spring bed structure has a pad casing on its upper surface and a cloth casing on its lower surface. It is difficult to clean the mattress casings of the second type of spring bed structure thoroughly. The methods of cleaning the mattress casings are limited to bask the bed mattress under the sunshine and to vaccum the bed mattress only, as rinsing and washing may damage the bed mattress. Furthermore, it is so inconvenient that the user has to remove the bed mattress outdoors in order to bask it. The pad casing or the cloth casing of the mattress cannot be repaired nor replaced owing to the torn or soiled damage, so the whole spring bed mattress has to be replaced leaving the bed frame without the mattress. The fixed elasticity of the spring bed structures is another disadvantage for the users. The user cannot adjust the elasticity of a spring bed structure to an exact hardness to suit his feeling. That is the reason why a user cannot sleep comfortably in a spring bed structure other than his own. The huge volumes of the spring bed structures that are produced currently may cause two problems. The first problem which is described as above cannot be overcomed by the users in general. The second problem is that the manufacturer or the store owner has to store the spring bed structures in a large storage area and must hire more workers to move the heavy spring bed structures.

SUMMARY OF THE PRESENT INVENTION

The main object of the present invention is to provide a combined bed structure whose cover layer is easily removable in order to clean the cover layer thoroughly and to extend the period of life usage of the cover layer for the user.

Another object of the present invention is to provide a combined bed structure which is easily removable and can be stored in a limited storage area for the manufacturer.

A further object of the present invention is to provide a combined bed structure whose mattress' elasticity is adjustable to an exact hardness to suit the user's feeling so that the user can sleep comfortably on any combined bed structure of the present invention.

DESCRIPTION OF THE PREFERRED EMBODIMENT

Figure 1:
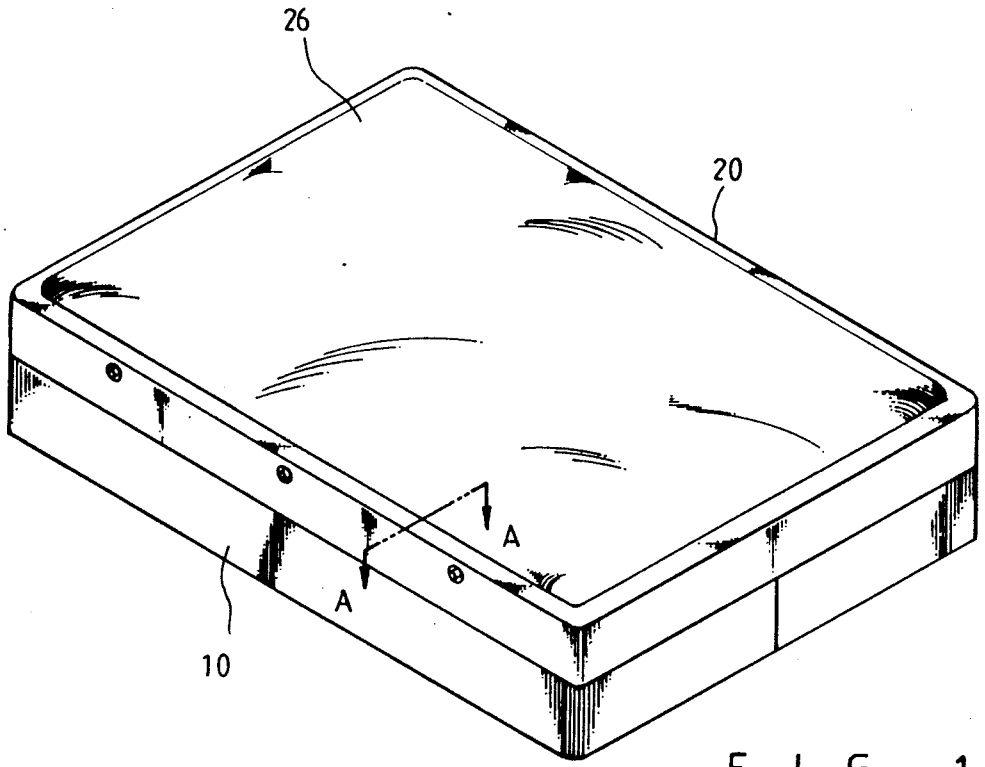
FIG. 1 is an assembly perspective view of a combined bed structure embodying the present invention.

Referring to FIG. 1, a combined bed structure generally comprises a box-shaped frame support 10 and a complete mattress frame 20 which is layed on the frame support 10. Now referring to FIG. 2, the mattress frame 20 has a frame casing 21, an inflatable mattress 24 and a cover layer 26. The rectangular frame casing 21 which forms a rectangular hollow space has an inwardly protruding ridge support 211 at its bottom inner periphery and an inwardly extending ridge support 251 at its top inner edge. A plurality of panels 22, stacked side by side, having length corresponding to the width of the frame casing 21 form a bottom portion of the frame casing 21 to creases a receiving space 23. The inflatable mattress 24 which is formed by connecting a plurality of inflatable sacks 241 side by side is disposed within the receiving space 23. On longitudinal side of each inflatable sacks 241 has an air nozzle 242 which is provided for inflating air into or deflating air out from the corresponding inflatable sacks 241. Respective to each air nozzle 242, one longitudinal side of the frame casing 21 has a plurality of nozzle-receiving sockets 212. The air nozzles 242 are inserted to slightly pass through the corresponding sockets 212 respectively, so that a small section of each air nozzle 242 will protrude from each socket 212 respectively. The volume of each inflatable sack 241 is adjustable by the inflation or deflation of air through its air nozzle 242. Thus, the softness of the mattress 24 can be adjusted to match the body position of the user.

Figure 3:
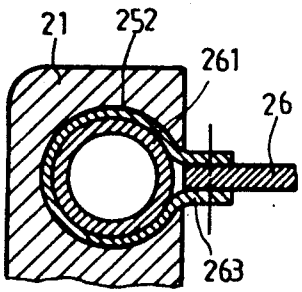
FIG. 3 is an assembly sectional view of a complete mattress frame of the combined bed structure embodying the present invention.
Figure 2:
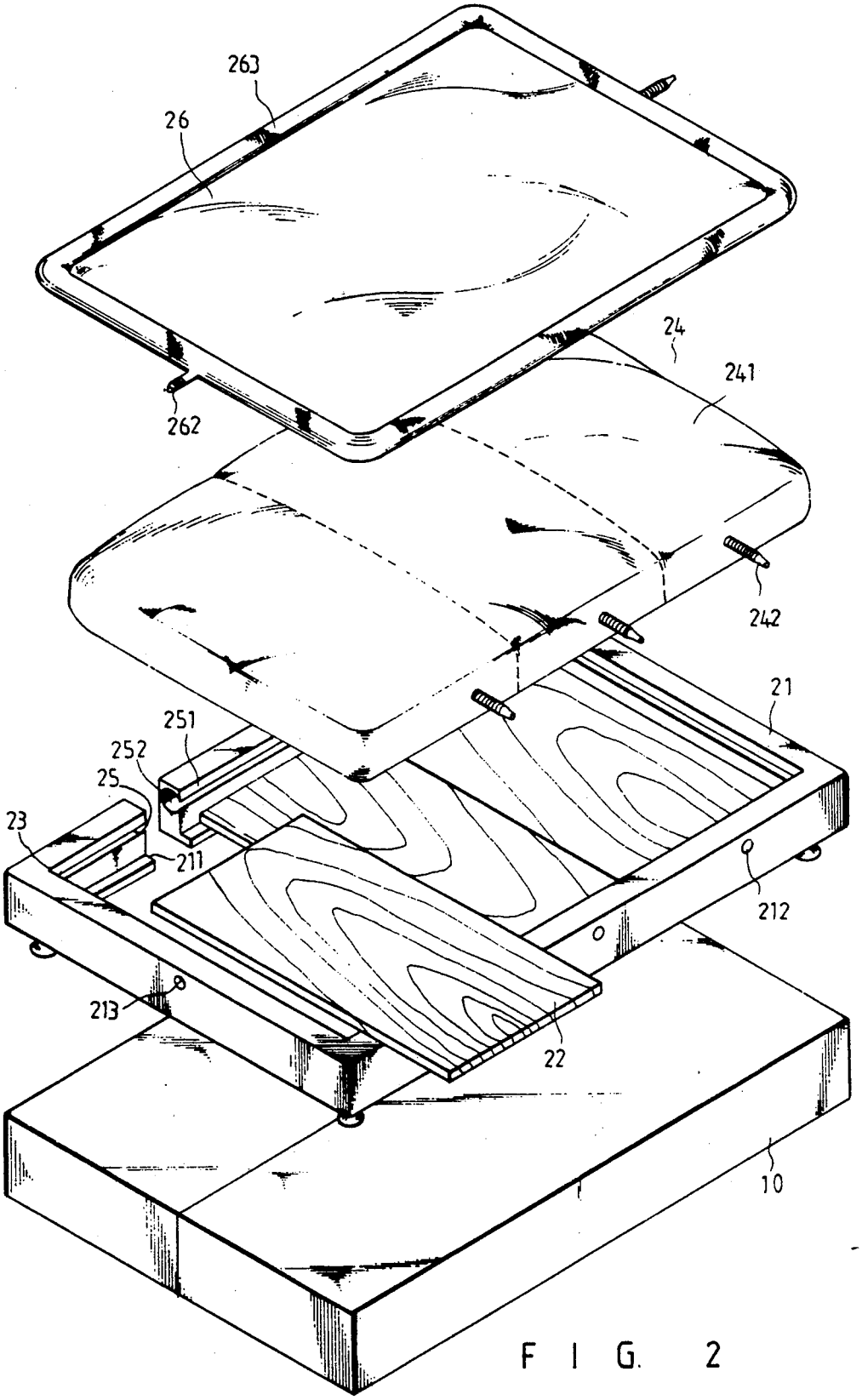
FIG. 2 is a fragmentary perspective view of a combined bed structure embodying the present invention.

The top inner edge of the frame casing 21 provides an inner frame slot 25 which includes the inwardly extending ridge support 251 and a tube-receiving slot chamber 252. The size of the cover layer 26 is approximately one-tenths smaller than the size of the frame casing 21. Referring to FIGS. 2 and 3, the periphery of the cover layer 26 is attached to a hollow inflatable elastic tube 261 which is enclosed by a fixing frame 263 along the periphery of the cover layer 26 to fixedly secure the hollow inflatable elastic tube 261. Each lateral side of the frame casing 21 has an access tube 213 at its upper middle point. Respective to the access holes 213, two elongated pressure controlling nozzles 262, respectively protruding outwardly from the middle outer circumference of both the lateral sides of the hollow inflatable elastic tube 261, are respectively inserted into the two access holes 213. And the head sections of the pressure controlling nozzles 262 then passes through and extends out from the two access holes 213 to ensure that the air can be inflated into or deflated through the hollow inflatable elastic tube 261 without taking out the cover layer 26. The hollow inflatable elastic tube 261 is fixedly secured in the tube-receiving slot chamber 252 of the inner frame slot 25 through its slot opening by means of expansion after air-inflating. Thus the cover layer 26 will be covered on the upper surface of the inflatable mattress 24.

The combination of the combined bed structure embodying the present invention is shown in FIGS. 3 and 2. A deflated mattress 24 is disposed within the receiving space 23 of the frame casing 21 whose bottom portion is provided with the panels 22 for its resting thereon. Then each air nozzle 242 is inserted to slightly pass through its corresponding nozzle-receiving socket 212. The deflated hollow inflatable elastic tube 261 is inserted into the tube-receiving slot chamber 252, and each pressure controlling nozzle 262 is inserted into the corresponding access hole 213 with its head section slightly passing therethrough. The hollow inflatable elastic tube 261 will fully expand in the slot chamber 252 after the user inflates air. Thus the cover layer 26 is fixedly secured in the tube-receiving slot chamber 252 of the frame casing 21. Each inflatable sack 241 is inflated by inflating air through the air nozzle 242. Then the whole mattress 24 is in the inflated state. The mattress frame 20 can be easily dismantled. The deflated mattress 24 and the deflated hollow inflatable elastic tube 261 of the cover layer 26 which are easily stored in a limited space are very light in weight to be transported. The cover layer 26 can be easily removed by deflating the hollow inflatable elastic tube 261 in order to clean or replace the worn cover layer 26. Thus the durability of the cover layer 26 and the mattress 24 is extended. The user can also adjust the inflated condition of each inflatable sack 241 to suit the user's feeling of his body's exact softness of each inflatable sack 241 so that the user can sleep very comfortably on the combined bed structure embodying the present invention.

Further modifications of the invention herein described will occur to persons skilled in the art and all such modifications are deemed to be within the scope of the invention as defined by the appended claims.

I claim:

1. A combined bed structure comprising:

a mattress frame having a frame rectangular casing having longitudinal and lateral sides, a complementary inflatable mattress and a complementary cover layer thereof, same frame casing having at a bottom inner periphery an inwardly protruding ridge support for a plurality of panels resting thereon and defining a receiving space for supporting said inflatable mattress therewithin; one longitudinal side of said frame casing having a plurality of nozzle-receiving sockets, and the middle of each lateral side of said frame casing having an access hole; an inner frame slot with a slot opening and a tube-receiving slot chamber; said frame casing having an inner surface said inflatable mattress having a plurality of air nozzles at one longitudinal side for inserting in each said nozzle-receiving sockets to slightly pass therethrough for the inflation and deflation of said inflatable mattress; said cover layer having its periphery attached to a hollow inflatable elastic tube which is inserted within said tube-receiving slot chamber, said hollow inflatable elastic tube having a pressure controlling nozzle formed at the middle of both lateral sides; said cover layer covering said mattress by inserting said deflated hollow inflatable elastic tube in a deflated state through the slot opening of said inner frame slot and passing said pressure controlling nozzles through said access holes respectively, and then inflating said tube in said tube-receiving slot chamber by means of said pressure nozzles.

2. A combined bed structure according to claim 1 wherein, a frame support for said mattress frame is provided under said mattress frame.

3. A combined bed structure according to claim 1 wherein, each said pressure controlling nozzle extends outwardly from the outer circumference of both the lateral sides of said hollow inflatable elastic tube corresponding to each said access hole which is formed on both the lateral sides of said frame casing.

4. A combined bed structure according to claim 1 wherein, said inflatable mattress being formed by a plurality of inflatable sacks, each sack having an air nozzle corresponding to a nozzle-receiving socket, for the inflation and deflation of said inflatable sacks.

* * * * *